US005556589A

United States Patent [19]

Sibal

[11] Patent Number: 5,556,589

[45] Date of Patent: Sep. 17, 1996

[54] PROCESS OF USING A SPIN PACK FOR MULTICOMPONENT FIBERS

[75] Inventor: Shiv Sibal, Conyers, Ga.

[73] Assignee: Hercules Incorporated, Wilmington, Del.

[21] Appl. No.: 301,914

[22] Filed: Sep. 7, 1994

[51] Int. Cl.[6] ..... D01D 5/253; D01F 8/06; D01F 8/12; D01F 8/14

[52] U.S. Cl. ..... 264/172.12; 264/172.14; 264/172.15; 264/172.17; 264/172.18

[58] Field of Search ..... 264/171, 176.1, 264/177.13, DIG. 26, 172.11, 172.12, 172.14, 172.15, 172.17, 172.18

[56] References Cited

U.S. PATENT DOCUMENTS

| | | | |
|---|---|---|---|
| 3,453,689 | 7/1969 | Hume . | |
| 4,115,620 | 9/1978 | Gupta et al. | 428/374 |
| 4,406,850 | 9/1983 | Hills | 264/171 |
| 5,411,693 | 5/1995 | Wust, Jr. . | |

FOREIGN PATENT DOCUMENTS

| | | |
|---|---|---|
| 972932 | 10/1964 | United Kingdom . |
| 1061692 | 3/1967 | United Kingdom . |
| 1101452 | 1/1968 | United Kingdom . |
| 1120241 | 7/1968 | United Kingdom . |

OTHER PUBLICATIONS

Abstract of Japan 54–125,717 (Published Sep. 29, 1979).
C. J. Wust, et al. "Fibers (Olefin)", *Kirk–Othmer Encyclopedia of Chemical Technology* (4th Ed. 1994).
Abstract of Japan 48–29,804 (published Mar. 8, 1973).
Serial No. 08/177,749 (filed Jan. 5, 1994).
Patent Abstracts of Japan—Publicationi No. JP58126312.
Patent Abstracts of Japan—Publicationi No. JP57176210.
Patent Abstracts of Japan—Publicationi No. JP63256708.
European Search Report (dated Jan. 18, 1996).

*Primary Examiner*—Leo B. Tentoni
*Attorney, Agent, or Firm*—Mark D. Kuller; Bradley N. Ruben

[57] ABSTRACT

The invention is directed to a device for spinning fibers, especially bicomponent fibers having a sheath/core configuration. The device has, in a preferred embodiment, disposed in the spinneret orifices a grooved pin with an axial bore (a hollow pin). A polymer distribution assembly is provided for directing separate sheath and core compositions to the grooves and the bore, respectively, such that the sheath and core compositions are co-spun from the spinneret orifice. The device can be easily disassembled and a different pin configuration inserted to alter the geometry and/or ratio of the sheath and/or core sections of the fiber.

24 Claims, 7 Drawing Sheets

PROCESS OF USING A SPIN PACK FOR MULTICOMPONENT FIBERS

BACKGROUND OF THE INVENTION

1. The Field of the Invention.

The present invention is directed to a device useful for spinning fibers, especially those having a core component surrounded at least partially by at least one outer or sheath component, and to methods for using the device in the production of such fibers.

2. The Background of the Art.

Whereas natural fibers and many synthetic fibers are composed of a single material constituent, the further development of different types of polymers for synthetic fibers has allowed for the production of "multicomponent" fibers (such as "bicomponent" fibers); that is, a fiber having two or more distinct polymeric components. A unitary fiber can be spun from a blend of distinct polymeric components. More conventionally, the distinct polymeric components of a multicomponent fiber are provided separately in a particular geometric arrangement in the fiber; that is, a cross-section of the fiber evidences at least two distinct polymeric compositions in selected areas of the cross-section. The ability to use different materials in a single fiber allows the designer to alter or augment the properties from those of a single component fiber.

The particular geometric arrangement of multicomponent fibers can be categorized in a number of ways. True multicomponent fibers consist of two or more components divided, along the length of the fiber, into two or more essentially distinct regions, best observed in a cross-sectional view of the fiber. Typical cross-sectional geometries for bicomponent fibers include a side-by-side arrangement, such as two equal semi-circles in abutment, and sheath/core arrangement, which would appear as an annulus. Other types of multicomponent fibers have compositions which vary laterally along the fiber length, and which might appear in cross-section as a circle cut into four, six, or eight pie-like pieces. These are typically called "conjugate" fibers, and can be spun by such devices as described in JP 73-029,804, U.S. Pat. No. 2,758,553, and U.S. Pat. No. 3,230,972, in which an apparatus is provided in the device to divide the molten polymer stream into multiple feeds that converge into each individual spinneret orifice. Yet other fiber designs include a sheath or matrix having a plurality of cores. A general overview of multicomponent fibers is provided in "Bicomponent Fibers, a review of the literature," Report No. 44, published by TRI/Princeton, Princeton, N.J. (December 1993).

The spinning of concentric sheath/core fibers is typically achieved by separately channelling at least two spinnable liquids to a specially designed spinneret orifice from which the fiber is spun. The orifices are typically composed of inner and outer orifices, each supplying one of the spinnable components. Eccentric sheath/core fibers can be made by offsetting the inner orifice position with respect to the outer orifice geometry; sheath/core fibers can be provided such that one or both components are in a non-circular geometry by varying the geometry of the particular orifice through which the material is spun (such as described in GB 1,120,241). In various devices for spinning sheath/core fibers, the sheath component is metered between plates through which tubes or pipes run with the core component metered therethrough. The sheath component flows between the tube and the plate though which the tube runs and is co-spun with the core component. An example of such a device is described in JP 54-125717.

A "spinning pack" used for spinning multicomponent fibers generally contains an assembly including a number of elements for channeling the flows of each of the fiber components, optionally including one or more filters for each component, and a spinneret assembly including a plurality of orifices in which the flows are joined and then extruded as the spun fiber. Modification of the geometric arrangement of the fiber components and/or the relative ratios of the fiber components requires some retooling of the assembly, or the need to have a number of different spinneret assemblies which can be substituted for that being used to spin a particular multicomponent fiber.

SUMMARY OF THE INVENTION

One object of the present invention is to provide a novel spinning pack which allows the artisan to vary the geometry arrangement and/or relative ratio of sheath and core components without having to retool the apparatus.

Another object of the present invention is to allow the artisan to vary the physical and performance characteristics of fibers by utilizing particular geometric arrangements and/or the relative ratios of the components in a multicomponent fiber, and to manufacture such fibers using a spinning pack in which the geometric arrangement and/or relative ratio of these components can easily be varied to achieve the desired physical and performance characteristics for a particular fiber.

In general, the present invention a novel spinning pack for spinning multicomponent fibers, comprising a spinneret assembly comprising a least one spinning orifice, a flow assembly operably associated with the spinneret assembly and comprising separate first and second flow channels for distributing first and second spinnable liquids to the spinneret assembly, a solid pin having an outside surface and having at least one inner fluid flow channel extending longitudinally therethrough, the pin being disposed within the spinning orifice, the inner fluid flow channel being in fluid communication with the first flow channel for directing the first spinnable liquid through the inner fluid flow channel so as to be spun through the spinning orifice, and means in fluid communication with the second flow channel for directing the second spinnable liquid longitudinally around the outside surface of the pin effective to be co-spun through the spinning orifice with the first spinnable liquid.

More particularly, this invention provides a spinning pack for spinning multicomponent fibers which comprises (i) a spinneret assembly comprising a least one spinning orifice, (ii) a flow assembly operably associated with the spinneret assembly and comprising separate first and second flow channels for distributing first and second spinnable liquids, (iii) a solid pin having an outside surface and having at least one inner fluid flow channel extending longitudinally therethrough, the pin being disposed within the orifice, and the inner fluid flow channel in fluid communication with the first flow channel for directing the first spinnable liquid through the inner flow channel to be spun through the spinning orifice, and (iv) means in fluid communication with the second flow channel for directing the second spinnable liquid longitudinally around the outside surface of the pin effective to be co-spun through the spinning orifice with the first spinnable liquid. Spinnable liquids are preferably molten polymer compositions suitable for spinning in conventional melt spinning apparatus for making fibers. Preferred means for directing the second spinnable composition around the outside of the pin include one or more grooves in the outer surface of the pin, one or more grooves in the orifice in which the pin is disposed (or in an associated bushing), or some combination thereof.

The present invention provides in a preferred embodiment for spinning sheath/core bicomponent fibers a novel spinning pack which comprises a spinneret having at least one spinning orifice, a pin having an axial bore and grooves on its outer surface, the pin being disposed in the spinning orifice, and an assembly operably associated with the spinneret and having separate flow channels for distributing a core component to the axial bore of the grooved pin and a sheath component to the outer grooved portion of the pin. It is preferred to provide a novel spinning pack having multiple spinneret orifices. For a spinneret having a given orifice diameter, the number, depth, and arrangement of the grooves on the pin outer surface, as well as the number of and diameter of the bores, can be varied to provide the same fiber with a different ratio and/or geometric arrangement of the core and sheath components in the spun fiber.

This invention also provides a method of using the novel spinning pack, which comprises providing a first liquid spinnable composition to the first flow channel in the flow assembly, providing a second liquid spinnable composition to said second flow channels in the flow assembly, and drawing from the spinneret orifice a co-spun fiber comprising the first and second components in the form of an integral bicomponent fiber.

FIGS. *7a*, *7b*, and *7c* are optical microphotographs of sheath/core fibers made using the present invention.

Figure 8:
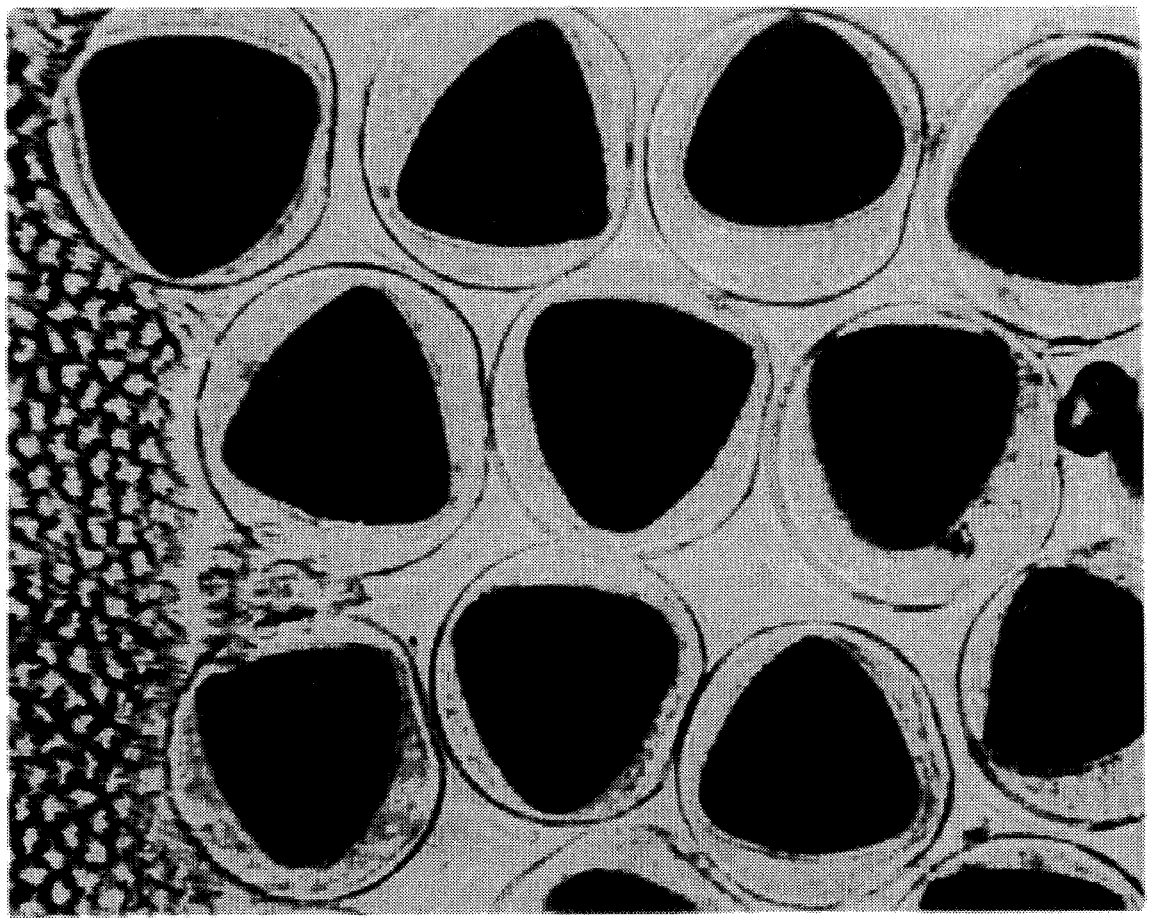

FIG. 8 is an optical microphotograph of sheath/core fibers made by the present invention wherein the core has a trilobal or triangularly-shaped cross-section.

DETAILED DESCRIPTION OF SPECIFIC EMBODIMENTS

The present invention will be described with particular reference to the production of bicomponent fibers, especially those having an essentially concentric sheath/core geometry, produced by melt spinning. Nevertheless, this invention is applicable to the production of fibers by wet- and dry-spinning techniques, as well as to bi- and multicomponent fibers having geometries other than concentric sheath/core; for example, such configurations as side-by-side, side-by-side-by-side, and matrix with multiple cores. Each of the separate components should be a liquid material suitable for spinning by conventional methods, such as melt-spinning, wet-spinning, and the like, using conventional equipment (i.e., "spinnable" as used herein). As such, when the invention is used with other than the melt-spinning techniques used specifically herein for descriptive purposes, it should be understood by the artisan that terms such as "spun fiber", "integral fiber", and the like will have some analog in a wet- or dry-spinning process, although such processes may require additional or alternative conventional steps to yield the analog. Each liquid can be of a desired composition that is sufficiently compatible with the other liquid(s) to provide an integral fiber suitable for handling and further processing as may be desired.

Figure 1:
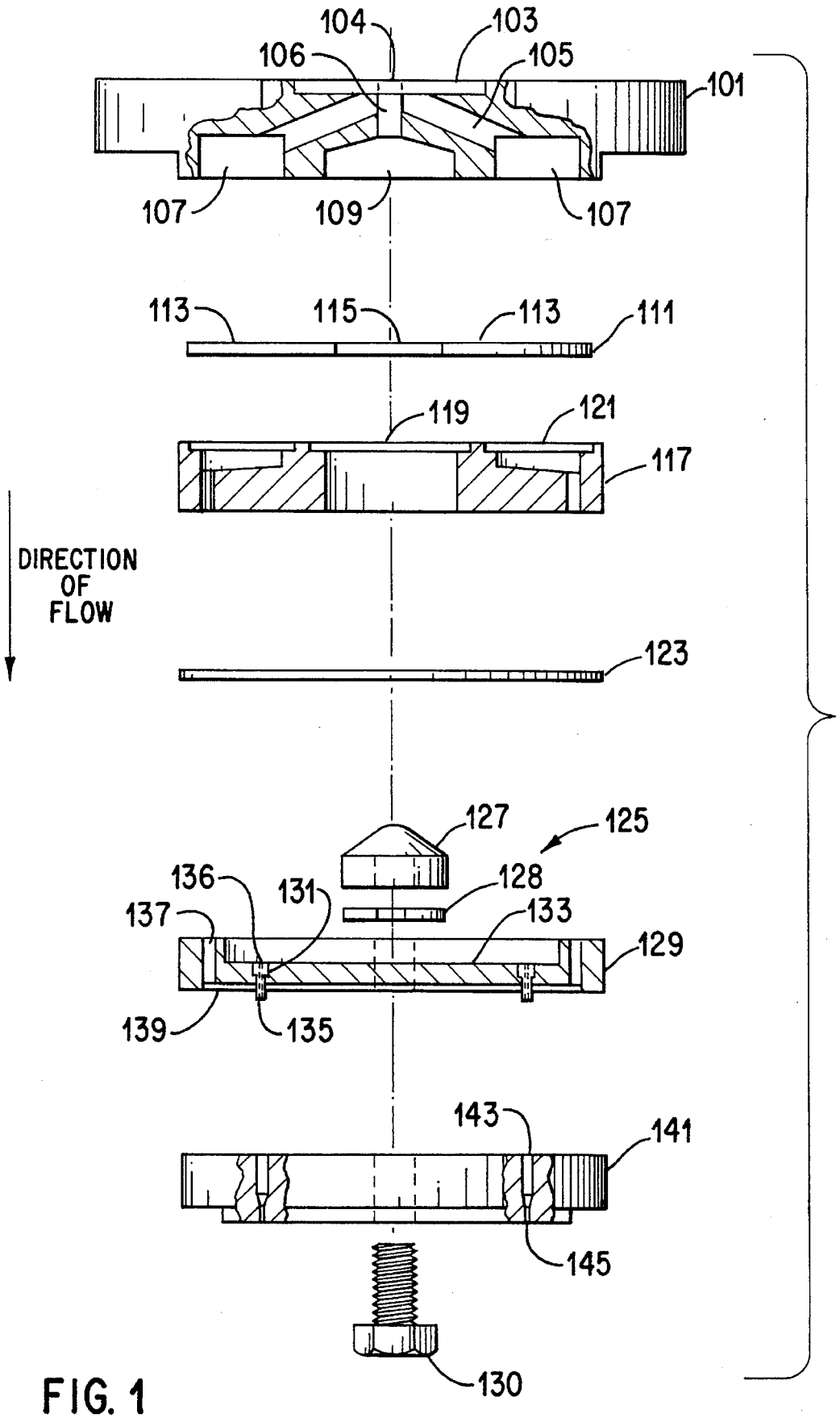
FIG. 1 depicts an exploded view of a spinning pack according to the present invention.

The invention will be generally described with reference to a sheath/core fiber formed by melt-spinning, without intending to limit the invention thereto. With reference to FIG. 1, feed plate 101 contains feed entrances 103 and 104 for introducing the sheath and core materials, respectively, which flow through separate respective channels 105 and 106 to their respective feed exits 107 and 109. Each flow entrance is in fluid communication with a pressurized source of polymer melt (not shown), such as screw-type melter extruder. It should also be appreciated that in the particular distribution assembly shown, the sheath component feed exit is in the form of an annulus around the core component feed exit. The feed materials are then fed to and filtered through one or more multilayer screens 111 which have different, separated sections 113 and 115 for filtering, respectively, the sheath and core compositions. Downstream, lower spinneret element 117 is provided, in part, as a retainer for the screen(s). The lower spinneret element includes a central flow passage conduit 119 in fluid communication with the feed exit 109 (downstream of filter section 115) for the core composition, and a distributor conduit 121 in fluid communication with the feed exit 107 for the sheath composition. The separate feed streams flow through aligned passages (not shown) in a gasket 123 whereupon they impinge the distribution assembly 125.

The distribution assembly 125 consists generally of a divergence hub 127, a distribution plate 129, and several pins 135. The divergence hub is separated from the distribution plate by a gasket 128 (preferably of aluminum construction), and both of which are held abutting the distribution plate by a threaded bolt 130. The bolt connects through the centers of both the distribution plate 129 and the spinneret assembly 141 (described below) and holds them in abutment to each other. The purpose of the divergence hub is to direct the flow of the core material from the flow passage 119 to a series of core distribution orifices 131 circumferentially spaced about the core distribution channel 133. Disposed within each core distribution orifice is a solid pin 135 having a bore 136 through which the core material flows the length of the pin. The sheath material is directed from flow passages 121 to one or more sheath distribution channels 137, and then into a flow space 139 adjacent a spinneret assembly 141. The pins have a length which is sufficient to allow the pin to pass through the flow space and to become at least partially disposed within an associated spinneret inlet 143 in the spinneret assembly.

The core material flows from the distribution channel through the bore of the pin and is spun through an associated spinneret outlet 145. This invention provides a means for directing the flow of the sheath material longitudinally around the pin so as to be co-spun with the core material. In one embodiment, this means comprises at least one groove in the pin (i.e., in the outside surface of the pin) through which the sheath material flows, effectively in a space between the pin and the spinneret inlet. The sheath and core flows meet at the lower end of the pin and proceed through and exit the spinneret outlet 145 as the spun multicomponent fiber. In addition to the various embodiments described below, the bore through the length of the pin can be of any desired geometry in which the resulting core material is to be formed. The bore may be circular, triangular, or square in cross-section, it may be asymmetrical, with curved and/or straight-sided walls, or any other geometry sufficient to provide a conduit for flow of the core material. If desired, there may be more than one bore, of the same or different geometry through the pin, through which is spun the same or a different core material. In the preferred embodiments shown having at least one groove in the outer surface of the pin, the groove(s) should extend from that portion of the pin adjacent the flow space to that portion within the spinneret inlet so as to provide a conduit for the flow of sheath material from the flow space, along the length of the pin, to be co-spun with the core material. In another embodiment (described below), the pin may have a smooth surface and the wall of the spinneret inlet can be provided with a number of grooves to allow flow of the sheath material along the length of the pin. As such, the present invention provides means in fluid communication with the flow space for directing the sheath material longitudinally around the outside of the pin so as to be co-spun with the core material flowing in the bore.

Figure 2:
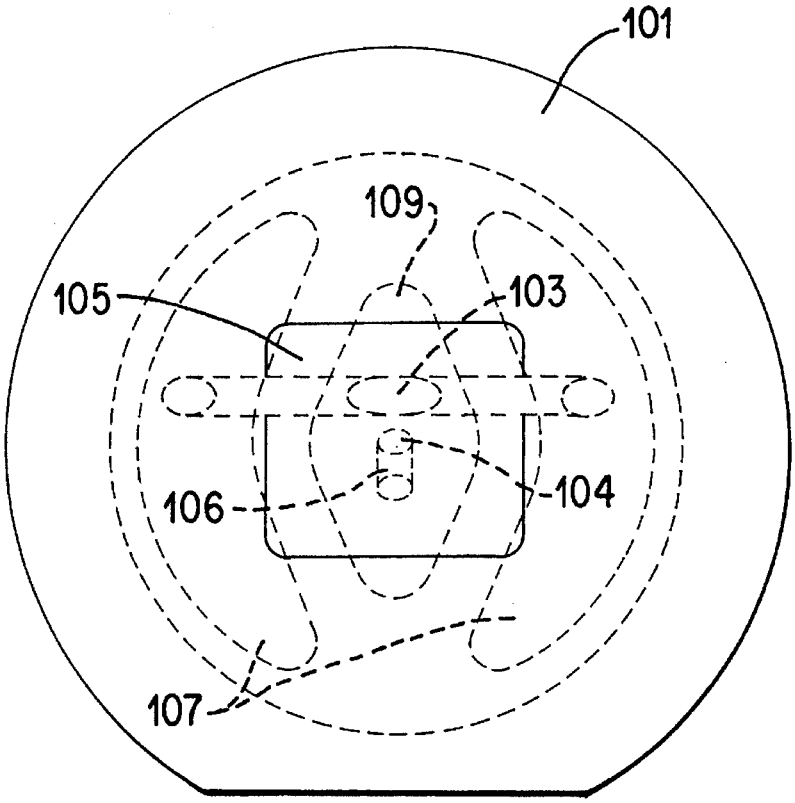
FIG. 2 depicts a top view of the spinning pack shown in FIG. 1.

FIG. 2 is a top view of the feed plate 101 shown in FIG. 1. The sheath material is provided under pressure to inlets 103 and the core material is provided under pressure to inlet 104. From each inlet, the material flows through its respective flow channel 105 and 106 to the feed exits 107 and 109.

Figure 3:
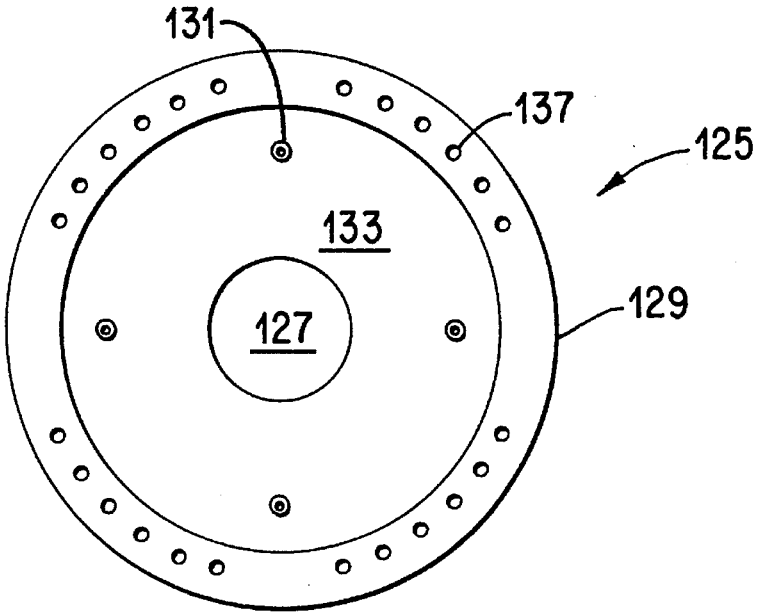
FIG. 3 depicts a top view of the distribution plate shown in the spinning pack of FIG. 1.

FIG. 3 is a top view of the distribution assembly 125 shown in FIG. 1. The divergence hub 127 causes the flow of the core material to spread along the channel 133 from where it exits though core distribution orifices 131 (only four of which are shown). The sheath material is distributed by channels 137 to the flow space between the distribution assembly and the spinneret assembly.

Figure 4A:
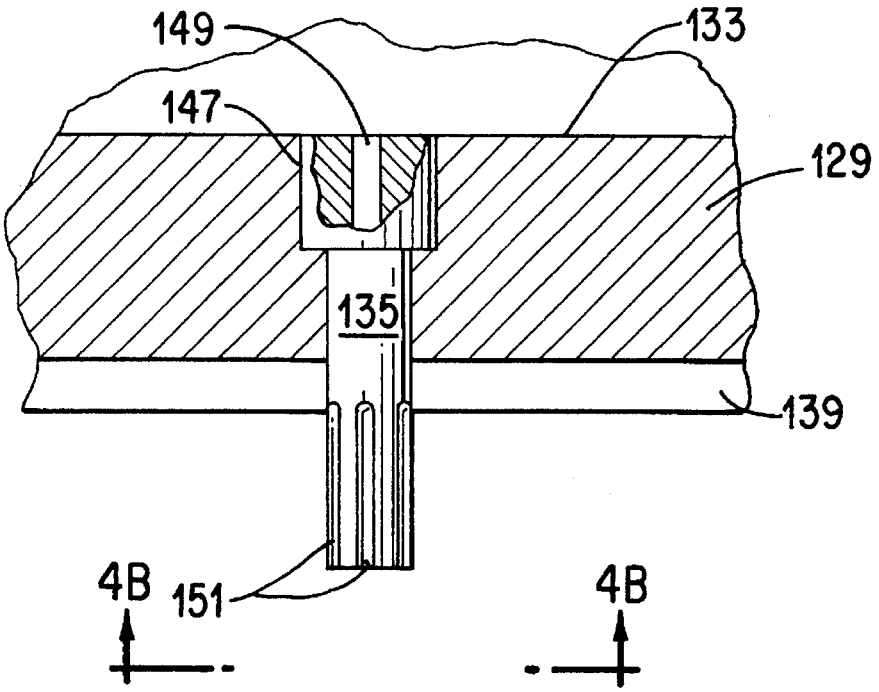
FIG. 4A depicts a cut-away view of a grooved pin partially disposed in the distribution plate used in the spinning pack shown in FIG. 1.
Figure 4B:
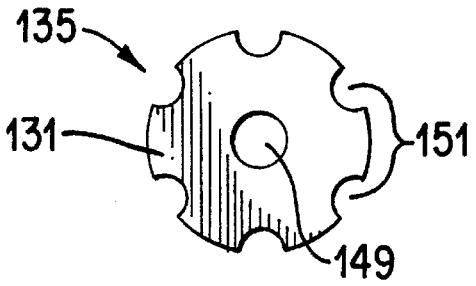
FIG. 4B is a bottom view of the grooved pin of FIG. 4A.
Figure 4C:
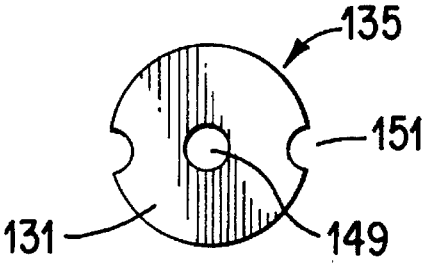
FIG. 4C is a bottom view of another embodiment of a grooved pin.

FIG. 4A depicts a pin 135 disposed in a core distribution orifice 131. The pin includes an upper collar portion 147 and is press-fitted into the orifice 131 in the distribution plate 129. The pin has, as a longitudinal flow channel, an essentially longitudinal bore 149 extending from the lower end of the pin opposite the collar portion preferably along the entire length of the pin. It is most preferred that the bore extend along the central axis of the pin. The lower end of the pin also contains a number of longitudinal grooves 151 on its outer surface. The grooves preferably extend from within the flow space 139 to within the spinneret inlet orifice to allow the sheath material to flow from the flow space around outside of the pin and envelope the core material exiting the bore at the lower end of the pin. FIG. 4B depicts a bottom view of the pin shown in FIG. 4A. Another embodiment is shown in FIG. 4C, in which the pin has two grooves; such a pin is suitable for spinning side-by-side-by-side fibers as described below.

Figure 5A:
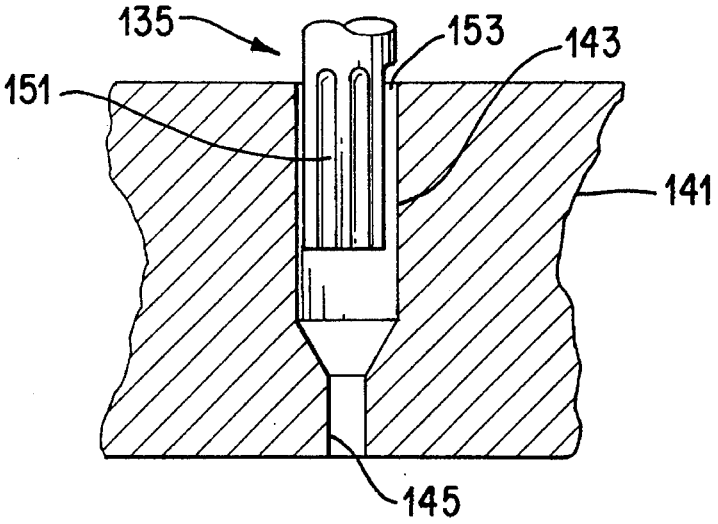
FIG. 5A depicts a cut-away view of a grooved pin disposed in a spinneret orifice in the spinning pack shown in FIG. 1.
Figure 5B:
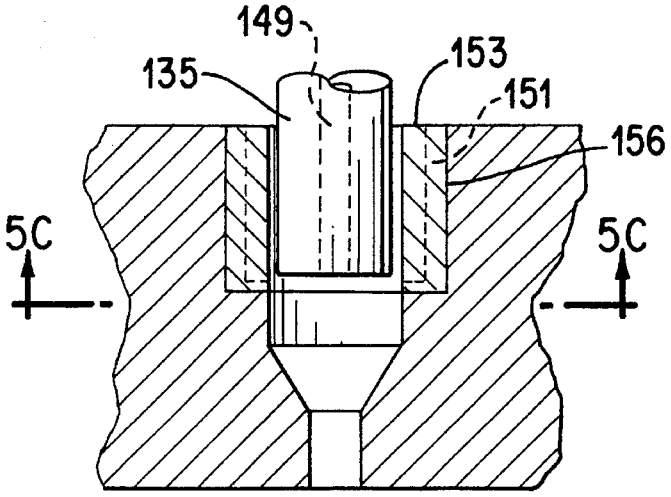
FIG. 5B depicts a view of a spinneret orifice in the spinning pack shown in FIG. 1 with grooves in the spinneret inlet orifice.
Figure 5C:
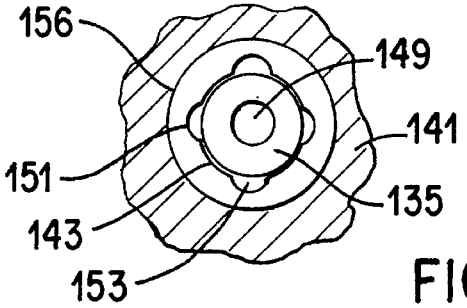
FIG. 5C is a view of the pin disposed in the grooved spinneret orifice in FIG. 5B taken up along line 5C—5C.

FIG. 5A depicts a detailed view of a spinneret in the spinneret assembly 141 in which a grooved pin 135 is disposed in the spinneret inlet orifice 143. The outer diameter of the pin should be of a tolerance with respect to the diameter of the inlet orifice such that a flow channel 153 is provided essentially only in the grooves of the pin; preferably, the outer diameter of the pin abuts the inner wall of the spinneret inlet orifice and the grooves are cut from the outer wall into the body of the pin to provide the flow channel(s). Another embodiment of the invention is depicted in FIG. 5B, in which the pin 135 has a smooth outer surface, and grooves 151 in the wall of the spinneret inlet orifice provide flow channels 153 for the flow of the sheath polymer; FIG. 5C is a view up along line 5C—5C shown in FIG. 5B. To facilitate changing the fiber design and avoid retooling the spinneret assembly, a removable bushing 156 having one or more grooves on its inner surface can be pressure-fitted into a corresponding socket in the spinneret assembly, and changed when a different fiber design is to be spun.

Figure 6A:
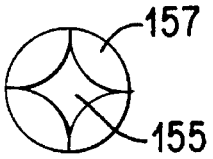
FIGS. 6A, 6B, and 6C depict idealized cross-sectional views of fibers made using the present invention with different grooved pins.
Figure 6B:
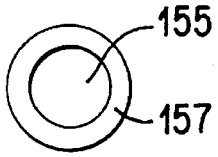
Figure 6C:
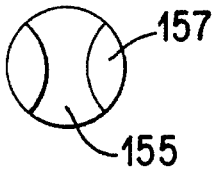

FIGS. 6A–C depict cross-sections of fibers spun using the present invention wherein the pin was provided with four grooves, six grooves, and two grooves, respectively. FIG. 6B depicts a cross-section typical of sheath/core fibers, and FIG. 6C depicts the cross-section of a side-by-side-by-side configuration. In all of the fiber geometries spun from this novel apparatus, it can be seen from the cross-sectional views that the fiber will have a core portion 155 surrounded at least partially by at least one surface portion 157; in other words, moving along the perimeter of the fiber, more than one of the fiber components may be encountered. The surface portion may be essentially continuous as shown in FIG. 6A, a continuous sheath as shown in FIG. 6B, or discontinuous as shown in FIG. 6C. It should be appreciated that by suitable variation in the depth, width, and number of grooves in the pin, a wide variety of cross-sections of bicomponent fibers can be made using this invention.

The sheath and core compositions can comprise any combination of compatible polymers. In one embodiment, the sheath composition has a melting (softening) point at least 20° C., more preferably at least 30° C., greater than the melting (softening) point of the core composition. In other embodiments, the core composition has a higher melting point than the sheath composition. It is preferable that both the sheath and core compositions be polyolefinic, and most preferably polyethylene and/or polypropylene, or a copolymer thereof. Exemplary sheath/core combinations include polypropylene/polyethylene, polypropylene/polypropylene-copolymer, polypropylene-copolymer/polyethylene, polyethylene/polypropylene, polypropylene-copolymer/polyethylene-copolymer, polyethylene-copolymer/polypropylene, and other combinations of polyolefin homopolymers and copolymers known in the art. When a relatively more expensive, specialty polymer is used for the sheath composition, it is preferably present in an amount of not more than about 50% by volume. An additive may be advisable with certain combinations of sheath and core materials if interfacial adhesion is found to be poor. Any pumpable material that can be spun into fibers from an orifice using conventional spinning equipment is suitable for use with the present invention and is considered to be spinnable. Without limitation, exemplary spinnable polymer compositions for the sheath and/or core component include polypropylene available as Hercoprime G (trademark of Hercules Incorporated, Wilmington, Del.), a maleated polypropylene, optionally compounded with Piccotac 115 (also trademark of Hercules Incorporated), a hydrocarbon resin (preferably reacted with 10% maleic anhydride), and Profax 6301 (available from Himont, Wilmington, Del.), a polypropylene resin; also suitable as the polyethylene is Aspun 6811A (fiber grade ethylene copolymer with octene-1, available from Dow Corp., Midland, Mich.). The sheath and core components may be the same or different materials and can generally include, without limitation, nylons (e.g., Nylon 6 and Nylon 66) and other polyamides, polyolefins such as polyethylene, polypropylene, polybutenes, and poly(4-methyl-1-pentene)s, polyesters such as poly(ethylene terephthalate), poly(vinyl acetate)s such as poly(ethylene vinyl acetate), and including copolymers of any of the foregoing, and mixtures or blends thereof; in general, any compatible or compatilizable fiber-forming components are suitable. One example of such a bicomponent fiber is a sheath/core fiber comprised of poly(ethylene vinyl acetate)/polyester. It may be desirable to provide a fiber having a polypropylene core and a polypropylene sheath wherein the polypropylene in the core and the sheath have different molecular weights or different molecular weight distributions.

The polymeric spinnable compositions can comprise polymers having a narrow molecular weight distribution or a broad molecular weight distribution, with a broad molecular weight distribution preferred for polypropylene.

Various additives, such as antioxidants, pigments, dyes, flame/smoke retardants, antistatic agents, antistain agents, and the like may be added alone or in combination to either or both of the sheath and core compositions. The present invention provides the benefit of being able to add a relatively costly additive in the sheath portion only, thereby reducing consumption of the component in the core where it will exhibit less of the desired effect. Likewise, various other components, including additives and/or other polymers, can be blended into a desired composition to alter its physical and/or chemical properties.

The spun fibers can be joined into a tow or yarn, wound, woven, crimped, chopped into staple fibers, or otherwise processed as desired. Surface modifying coatings, such as lubricating and/or antistatic spin finishes, can be added to facilitate processing as is well-known in the art. Preferred for many applications are crimped, staple fibers having lengths of about one to six inches (approximately 2½ to 15¼ cm.), more preferably about one to three inches (approximately 2½ to 7¾ cm.), and most preferably about 1¾ to two inches (approximately 3 to 5 cm.) and having a dpf of 0.1 to 40, more preferably one to six.

Thus, in summary, this invention provides in one embodiment a device generally comprising a spinneret having at least one orifice through which first and second liquid spinnable compositions are spun in the form of a bicomponent fiber; in a multiorifice spinneret, the orifices are generally arranged in a circular pattern. The device also comprises a flow assembly operably associated with the spinneret for distributing the first and second liquid spinnable compositions, preferably in the form of polymer melts, to the spinneret orifice(s). Disposed in each spinneret orifice is a solid pin having a longitudinal flow channel, preferably extending along the pin axis, and most preferably extending the entire length of the pin. Through this longitudinal flow channel the first or core liquid spinnable composition is spun. To spin the second (or sheath) portion of the fiber around the first (or core) portion, means is provided in fluid communication with that portion of the flow assembly through which the second composition flows effective to direct the second composition longitudinally around the outside of the pin disposed in the orifice so as to be co-spun with the first composition as an integral bicomponent fiber; exemplary means include at least one groove disposed longitudinally along the outside of the pin, at least one groove disposed longitudinally in the spinneret orifice, or a combination of grooves in both the pin and the orifice.

EXAMPLES 1–12

Sheath/core bicomponent fibers were melt spun using a number of different compositions as shown in Table 1. The apparatus used for these examples, essentially the same as described above for the preferred embodiment having grooved pins, and was made of 416SS stainless steel. Two spinning packs were mounted in one housing, each spinning pack having a diameter of 100 mm with 36 spinneret orifices. The pins had a bore diameter of 0.040 in. and an outer portion (in which the grooves are provided) with a diameter of 0.103 in. Six grooves were present in each outer portion and were spaced equidistantly about the circumference of the pin, each groove being 0.005 in. deep and 0.015 in. wide. Each liquid spinnable composition was provided as a polymer melt to the spinning packs using a screw-type extruder; separate extruders were used to supply each of the sheath and core compositions. The spinneret was heated and the outlet temperature at the spinneret orifice was recorded. The fibers were taken up at 1000 m/min and had dpf of about 4½ at draw ratio of about 3.4; the denier was thereafter determined.

The particular materials melt-spun, as shown in Table 1, were: Profax 6301 (available from Himont, Wilmington, Del.), a polypropylene resin; visbroken Profax 6301 (also available from Himont), a polypropylene resin processed under specific visbreaking conditions; and Hercoprime G (available from Hercules Incorporated, Wilmington, Del.), a maleated polypropylene resin.

These various polymers and blends were spun in the apparatus described above and under the conditions shown in Table 1.

TABLE 1

| | Sheath | Core | Screw Pressure (psi) | | Spin Head | Spun |
|---|---|---|---|---|---|---|
| Example | 20 vol. % | 80 vol. % | core | sheath | Temp. °C. | Denier |
| 1 | Profax 6301 | Profax 6301 | 850 | 750 | 270 | 3691 |
| 2 | Nylon 6 | Profax 6301 | 1000 | 900 | 300 | 3726 |
| 3 | Profax 6301 | Profax 6301 | 800 | 800 | 265 | 3600 |
| 4 | Visbroken Profax 6301 | Profax 6301 | 1000 | 1000 | 275 | 3700 |
| 5 | Nylon 6 modified with 5% Hercoprime G | Profax 6301 | 1000 | 1500 | 300 | — |
| 6 | Nylon 6 modified with 5% $C_5$ maleic anhydride | Profax 6301 | 1000 | 1500 | 300 | — |
| 7 | Nylon 6 modified with 10% $C_5$ maleic anhydride | Profax 6301 | 1000 | 1500 | 300 | — |
| 8 | Nylon 6 modified with 10% Hercoprime G | Profax 6301 | 1000 | 1000 | 300 | — |

TABLE 1-continued

| Example | Sheath 20 vol. % | Core 80 vol. % | Screw Pressure (psi) core | Screw Pressure (psi) sheath | Spin Head Temp. °C. | Spun Denier |
|---|---|---|---|---|---|---|
| 9 | Nylon 6 modified with 5% Hercoprime G | Profax 6301 modified with 5% Hercoprime G | 1000 | 1000 | 300 | — |
| 10 | Nylon 6 modified with 5% $C_5$ maleic anhydride | Profax 6301 modified with 10 wt. % Hercoprime G | 1000 | 1000 | 300 | — |
| 11 | Nylon 6 | Profax 6301 modified with 5% $C_5$ maleic anhydride | 1000 | 1000 | 300 | — |
| 12 | Nylon 6 | Profax 6301 modified with 10% $C_5$ maleic anhydride | 1000 | 1000 | 300 | — |

Figure 7A:
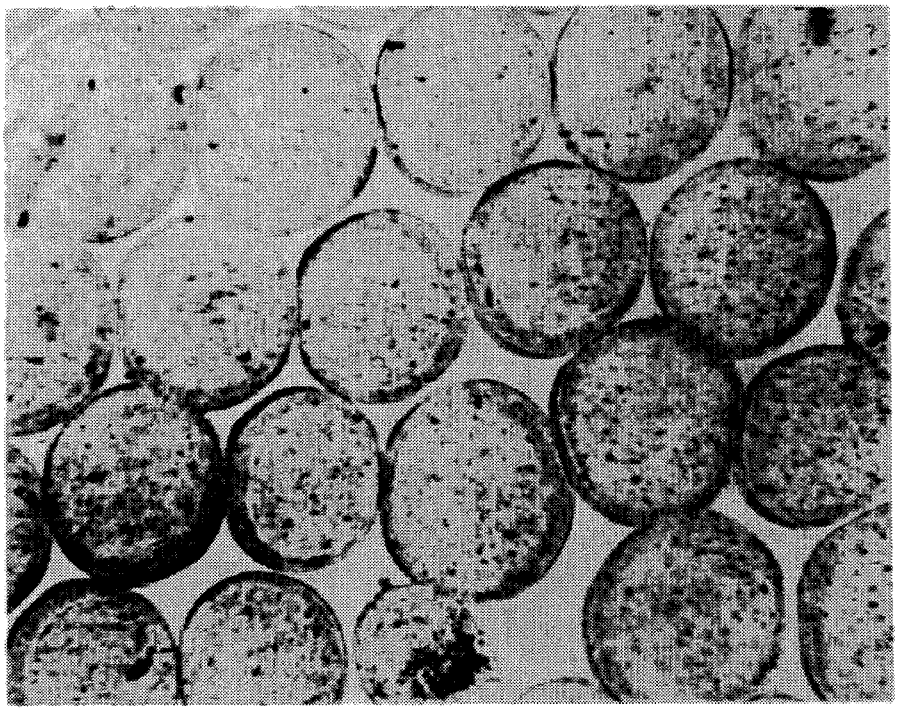
Figure 7B:
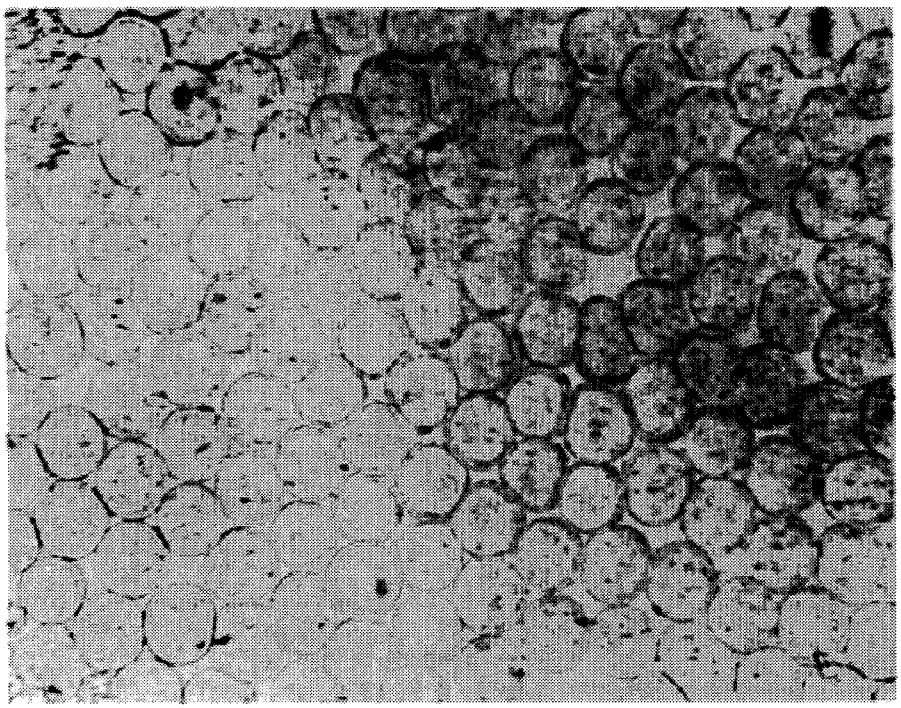
Figure 7C:
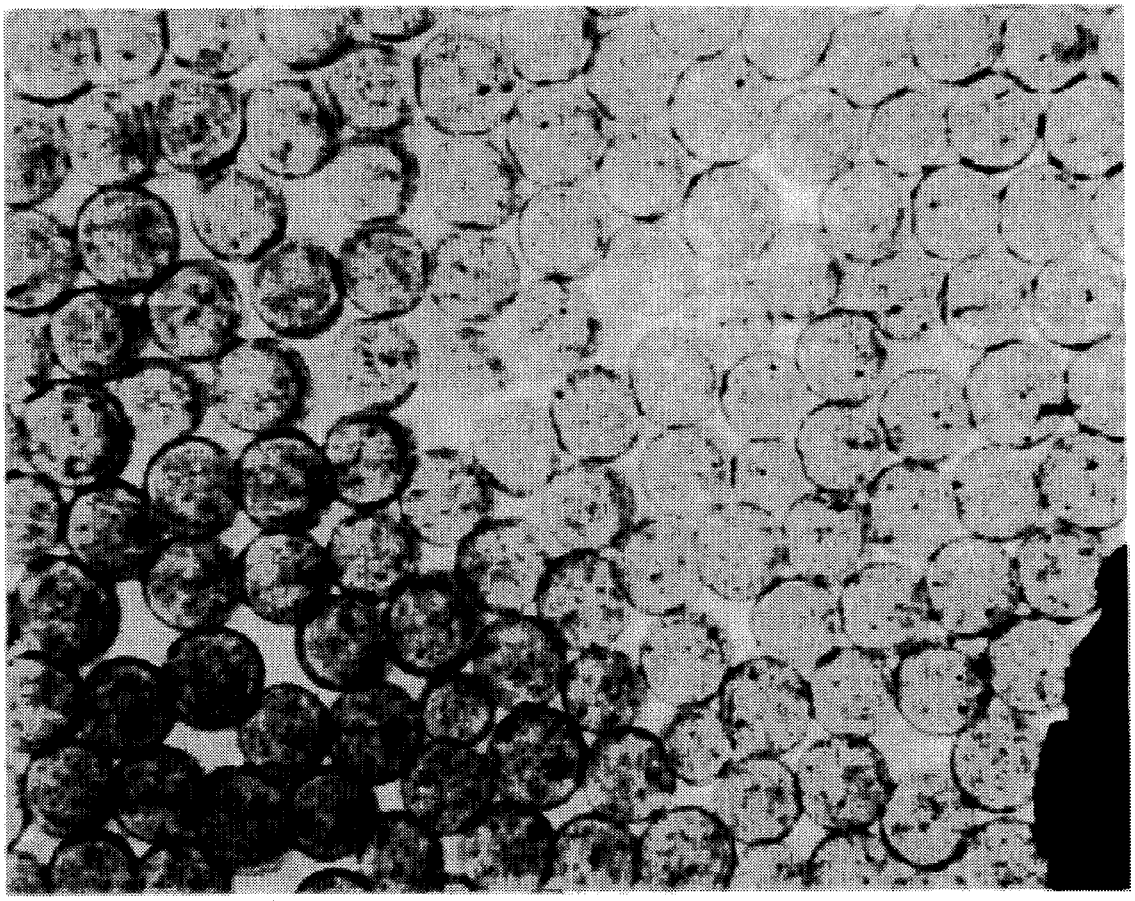

Fibers spun using various combinations of nylon and polypropylene are shown in FIGS. 7*a*, 7*b*, and 7*c*, optical micrographs (200× enlargement) of cross-sections of fibers spun using the inventive apparatus. As seen in the micrographs, the fibers have a well-defined cross-section with an essentially circular perimeter. The core is generally well-centered within the sheath component and also shows a well-defined circular perimeter.

EXAMPLE 13–18

The compositions shown in Table 2 were spun using pins having three grooves spaced equidistantly about the outside of the pin. These slots or grooves had dimensions of 0.020 in.×0.007 in., effective to produce a sheath/triangular core fiber. The sheath/core polymer ratio shown in Table 2 is based on the volume of the respective components when the spun fiber is viewed in cross-section.

An optical microphotograph of cross-sections of fibers spun using a pin having three grooves are shown in FIG. 8. As can be seen in the cross-section shown, the core has a trilobal or triangular geometry and is well-centered and concentrically within a sheath having a circular perimeter.

The pin can be provided with any desired number of grooves of a particular geometry to alter the thickness of the sheath component and/or the shape of the core (as shown with the trilobal fiber examples). As shown in the figures, the grooves run axially along the outside of the pin; helical grooves may be desirable for certain sheath compositions or to achieve an aesthetic effect; and the grooves need not be spaced equidistantly about the pin girth. The axial bore of the pin is shown in the figures as having a circular cross-section; other cross-sectional geometries may be desirable.

TABLE 2

| Example | Sheath/Core Polymer Ratio | Sheath Composition | Core Composition | Appearance of Cross-section |
|---|---|---|---|---|
| 13 | 20:80 | Profax 6301 (18 MFR) | Profax 6301 (18 MFR) | round sheath/core |
| 14 | 20:80 | Nylon 6 | Polypropylene | — |
| 15 | 20:80 | Pigmented Profax 6301 | Pigmented Profax 6301 | good concentric sheath/core |
| 16 | 20:80 | Profax 6301 | Pigmented Profax 6301 | — |
| 17 | 30:70 | low melt index ethylene/propylene copolymer | Polypropylene | good distribution of sheath around core |
| 18 | 50:50 | low melt index ethylene/propylene copolymer | Polypropylene | poor |

The present invention has been described with reference to the foregoing description and particular examples without being limited by the particular content thereof, and various additions, substitutions, deletions, and other modifications thereof are intended to be within the scope and spirit of the invention as defined by the following claims.

What is claimed is:

1. A method of spinning multicomponent fibers, which comprises:

A. providing a spinning pack comprising:

(I) a spinneret assembly comprising at least one spinning orifice, a distribution plate, a flow space therebetween, and a solid pin disposed within said spinning orifice and extending into said flow space, said solid pin having an outside surface and having at least one inner fluid flow channel extending longitudinally therethrough; and (II) a flow assembly operably associated with the spinneret assembly and comprising separate first and second flow channels for distributing first and second liquid spinnable compositions to said spinneret assembly, said first flow channel in fluid communication with said inner fluid flow channel of said pin and said second flow channel extending about the circumference of the distribution plate and in fluid communication with the outside surface of said pin;

B. providing the first liquid spinnable composition to said first flow channel in the flow assembly and the second liquid spinnable composition to said second flow channel in the flow assembly; and C. drawing from the spinneret orifice a multicomponent fiber comprising the first and second compositions;

wherein said first liquid spinnable composition flows through said first flow channel and said inner fluid flow channel of said pin to be spun through said spinning orifice;

wherein said second liquid spinnable composition flows through said second flow channel about the circumference of the distribution plate, into said flow space, and longitudinally around the outside surface of said pin effect to be co-spun through the spinning orifice with the first spinnable liquid; and wherein (i) said outer surface of the pin has at least one groove therein or (ii) said pin is configured to provide a fiber other than a concentric single sheath/single core fiber.

2. The method of claim 1, wherein the multicomponent fiber is a bicomponent fiber.

3. The method of claim 2, wherein the first composition is selected from the group consisting of polyolefins, polyamides, and polyesters.

4. The method of claim 3, wherein the first composition is a polyolefin selected from polyethylene, polypropylene, or mixtures thereof.

5. The method of claim 1, wherein the second composition is a polymer melt.

6. The method of claim 5, wherein the second composition is a polymer blend.

7. The method of claim 6, wherein the second composition is selected from the group consisting of polyolefins, polyamides, and polyesters.

8. The method of claim 7, wherein the second composition is a polyolefin selected from polyethylene, polypropylene, or mixtures thereof.

9. The method of claim 1, wherein the fiber is a sheath/core fiber comprising a polyethylene sheath and a polypropylene core.

10. The method of claim 1, wherein the pin is configured for spinning sheath/core fibers.

11. The method of claim 10, wherein the pin is configured to produce a concentric sheath/core fiber.

12. The method of claim 10, wherein the pin is configured effective to produce a fiber having a core that is trilobal in cross-section.

13. The method of claim 1, wherein the pin is configured effective to provide a side-by-side-by-side fiber.

14. The method of claim 1 wherein said spinning pack further comprises means in fluid communication with said second flow channel for directing said second spinnable liquid longitudinally around the outside surface of said pin effective to be co-spun through the spinning orifice with the first spinnable liquid.

15. The method of claim 14, wherein said means comprises at least one groove disposed longitudinally in the outside surface of said pin.

16. The method of claim 14, wherein said means comprises at least one groove disposed longitudinally in a portion of said spinneret orifice adjacent said pin.

17. The method of claim 1, wherein the spinneret comprises a multiplicity of spinning orifices.

18. The method of claim 15, wherein the spinneret comprises a multiplicity of spinning orifices.

19. The method of claim 15, wherein the pin comprises up to six grooves.

20. The method of claim 15, wherein the pin comprises up to three grooves.

21. The method of claim 15, wherein the pin comprises six grooves.

22. The method of claim 1, wherein said inner fluid flow channel extends longitudinally along the entire length of the pin.

23. The method of claim 22, wherein the fluid flow channel extends along the axis of the pin.

24. The method of claim 1, wherein there are a plurality of flow channels.

* * * * *

UNITED STATES PATENT AND TRADEMARK OFFICE

CERTIFICATE OF CORRECTION

PATENT NO. : 5,556,589
DATED : September 17, 1996
INVENTOR(S) : Shiv Sibal

It is certified that error appears in the above-indentified patent and that said Letters Patent is hereby corrected as shown below:

Claim 7, Column 11, Line 15 replace "6" with --5--.

Signed and Sealed this

Twenty-sixth Day of November 1996

*Attest:*

Bruce Lehman

BRUCE LEHMAN

*Attesting Officer*

*Commissioner of Patents and Trademarks*